United States Patent [19]

Delnero

[11] Patent Number: 4,679,467

[45] Date of Patent: Jul. 14, 1987

[54] BROKEN CORK REMOVER

[76] Inventor: Thomas V. Delnero, 423 49th St., Apt. #1, West Palm Beach, Fla. 33407

[21] Appl. No.: 841,824

[22] Filed: Mar. 20, 1986

[51] Int. Cl.[4] ..... B67B 7/10

[52] U.S. Cl. ..... 81/3.07; 81/3.4

[58] Field of Search ..... 81/3.07, 3.4, 3.41, 81/3.09; 7/151

[56] References Cited

U.S. PATENT DOCUMENTS

| | | | |
|---|---|---|---|
| 47,161 | 4/1865 | Bielefield et al. | 81/3.07 |
| 889,474 | 6/1908 | Medley | 81/3.07 |
| 983,778 | 2/1911 | Sersen | 81/3.07 |

FOREIGN PATENT DOCUMENTS

| | | | |
|---|---|---|---|
| 339671 | 8/1921 | Fed. Rep. of Germany | 81/3.4 |
| 27343 | of 1904 | United Kingdom | 81/3.4 |

*Primary Examiner*—Roscoe V. Parker

*Attorney, Agent, or Firm*—Harvey B. Jacobson

[57] ABSTRACT

A tool for removing broken corks from bottles has an elongate transverse handle with a smaller end for pushing a cork into a bottle and a larger knob end for gripping in the hand. Between the ends of the handle is a transverse stem to which is attached opposite ends of a band forming a cork removing loop. The opposite ends of the band have internal projections which fit in recesses in the stem and are covered by a sleeve which can slide on the outside of the stem. This provides a particularly convenient form of attachment as between the band and the stem allowing for ready replacement of broken bands.

2 Claims, 4 Drawing Figures

BROKEN CORK REMOVER

BACKGROUND OF THE INVENTION

This invention relates to a tool for removing a cork from a bottle. More particularly, the invention relates to a tool for forcing a broken cork down the neck of a bottle into the main body of the bottle and for then removing the broken cork therefrom.

The problem of corks being broken in the neck of a bottle during removal, for example by a corkscrew, is extremely common. Generally, in this situation, the user pushes the cork down into the bottle where it remains while the contents of the bottle is emptied. This, however, may present problems insofar as when the bottle is still full, initially the cork may provide an impediment against the pouring of liquid from a bottle, frequently leading to spillage. There have been previous proposals for broken cork removal tools comprising of handle with a stem to which is secured the opposite ends of a band that forms a loop below the stem. In operation, the loop is inserted into a bottle and the handle is then manipulated so as to cradle the cork in the loop and remove same through the neck of the bottle. However, the force applied to the loop when removing the cork through the bottle neck may prove excessive and lead to breakage of the band. The previously proposed tools had no ready means for band replacement.

Examples of earlier forms of cork removing tools and the like are shown in U.S. Pat. Nos. 47,161, 72,247, 140,706, 199,760, 624,457, 889,474, 983,778, 1,215,308, 2,682,985, 2,985,045 and 3,678,788.

SUMMARY OF THE INVENTION

It is an object of the invention to provide an improved form of cork removal tool. To this end, the invention provides in one of its aspects a cork removal tool having a handle with a stem and a band for attachment at its opposite ends to the stem to form a cork removal loop. Preferably, the loop has internal projections at its opposite ends for receipt in corresponding recesses in the stem. The stem has an external sleeve which can move between a position exposing the recesses and allowing removal of the band, and another position in which it covers the recesses preventing removal of the band. Further, the band may have an external projection adjacent one of the internal projections that forms the stop for the sleeve preventing it from being removed from the stem when it covers the band projections. This form of attachment means as between the band and the stem provides a particularly convenient means for readily replacing bands should they become broken. Further, the bands may be molded in plastic material so that they are relatively cheap to produce and replace.

In another aspect of the invention, a cork removal tool has an elongate handle with a small section end for use in pushing a cork into the neck of a bottle, and a large section knob end to facilite gripping in the hand.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 4:
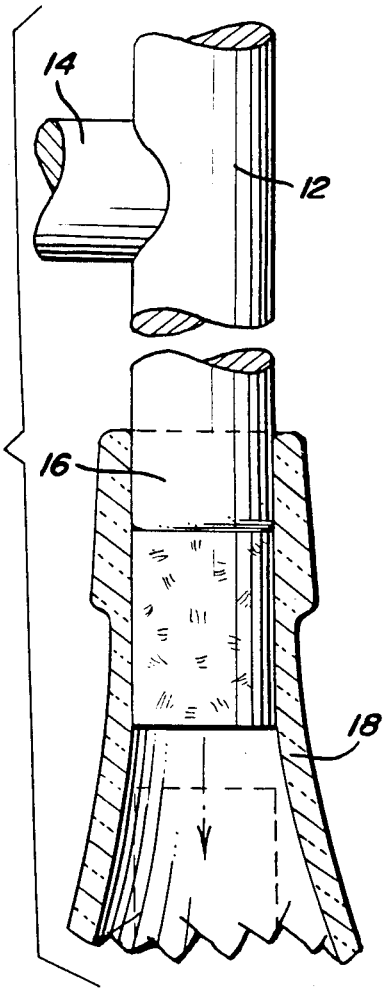
FIG. 4 is an enlarged in-use view of part of the handle of the tool.

A cork removal tool in accordance with the invention is generally indicated by reference numeral 10 in the drawings. The tool comprises an elongate handle 12 and a stem 14 projecting substantially transversely from the handle intermediate its ends. The stem and handle may be formed in any suitable material, for example wood or molded plastic. One end 16 of the handle is of relatively small diameter for particular use in pushing a broken cork into the neck of a bottle 18 as shown in FIG. 4, and the other end 20 of the handle is formed as as enlarged knob to facilitate gripping in the hand.

Figure 1:
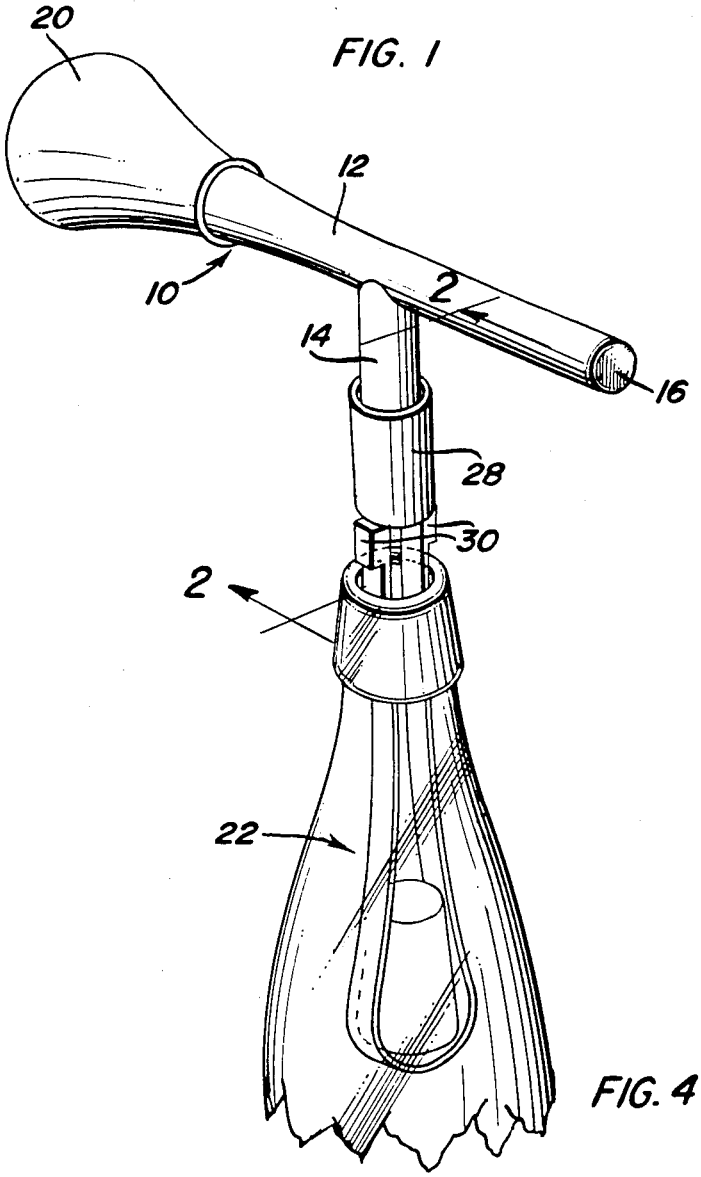
FIG. 1 is an in-use perspective view of a cork removal tool in accordance with the invention.

Additionally, the tool is provided with a band 22 of thin plastic material which has its opposite ends attached to the stem 14 (in a manner to be described) so as to form a loop projecting below the stem for use as shown in FIG. 1 in extracting a broken cork from within a bottle. To this end while holding onto handle 12, a user may manipulate the loop under a cork and forcibly pull same through the neck of the bottle.

Figure 2:
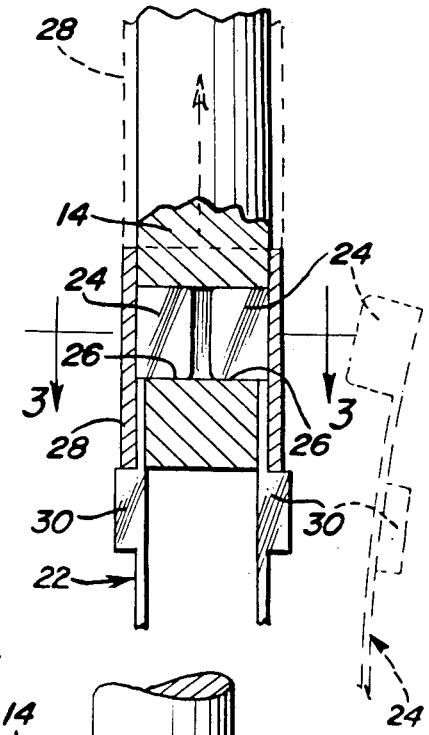
FIG. 2 is an enlarged sectional view on line 2—2 of FIG. 1.
Figure 3:
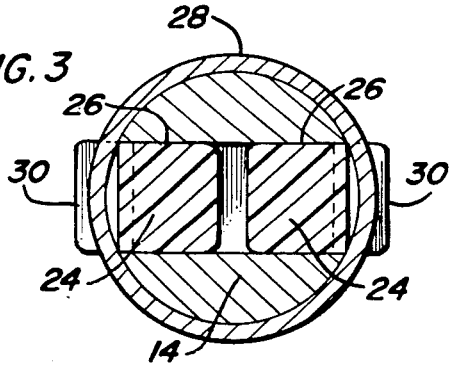
FIG. 3 is a sectional view on line 3—3 of FIG. 2

To form a readily replaceable detachable connection between band 22 and stem 14, each end of the band is provided with an internal projection 24 that may be an integral molding on the end of the band. The projections 24 fit in corresponding opposed recesses 26 formed in the stem 14. The recesses may be individual recesses or alternatively the stem may be provided with a circumferential groove defining the recesses. Moreover, the stem is provided with an external sleeve 28 which can be moved along the stem between an upper position, shown dotted in FIG. 2, in which the recesses 26 are exposed for insertion and removal of the respective projections 24 and a lower position, shown in FIG. 1 and in full line in FIG. 2 wherein the sleeve covers the projections and recesses therby preventing removal of the band from the stem.

In order to avoid removal of sleeve 28 from the stem when it covers the recesses 26, band 22 may be provided with additional integrally molded external projections 30 adjacent projections 24. It is evident that projections 30 effectively form stops for the sleeve 28 and prevent it from being removed from the stem. In practice, the band may be produced with only one of the external projections 30.

It will be evident that the band 22 may readily be replaced when broken by the convenient form of attachment means with the stem herebefore described. Accordingly, the tool can be economically provided with replaceable cork removing bands.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A tool for use in removing corks from bottles, said tool comprising an elongated handle including an elongated laterally projecting stem outwardly from said handle intermediate its opposite ends, opposite sides of said stem defining outwardly opening recesses formed therein, a flexible loop-forming band having generally parallel closely laterally spaced apart opposite ends between which said stem is receivable, the opposite ends of said band including inward projections receivable within said recesses, a sleeve mounted on said stem and shiftable therealong between an inactive position spaced along said stem toward said handle from said recesses exposing the latter for receiving said projections therein and allowing withdrawal of said projections therefrom and an active position shifted along said stem away from said handle with said sleeve registered with and extending lengthwise across said recesses closely outward of the corresponding ends of said band to prevent withdrawal of said projections from said recesses, and outward projections carried by said band ends spaced from the corresponding inward projections and engageable by the end of said sleeve remote from said handle to define a limit of movement of said sleeve along said stem to said active position.

2. The invention as defined in claim 1 wherein the handle includes a smaller-section end for pushing a broken cork into a bottle, and a larger-section knob end for gripping in the hand.

* * * * *